US006244091B1

(12) United States Patent
McClung et al.

(10) Patent No.: US 6,244,091 B1
(45) Date of Patent: Jun. 12, 2001

(54) APPARATUS AND METHOD FOR FORMING CUP-SHAPED MEMBERS

(75) Inventors: James A. McClung, North Canton, OH (US); Manuel P. Rubalcava, San Jose, CA (US)

(73) Assignee: Can Industry Products, Inc.

( * ) Notice: Subject to any disclaimer, the term of this patent is extended or adjusted under 35 U.S.C. 154(b) by 0 days.

(21) Appl. No.: 09/438,556

(22) Filed: Nov. 10, 1999

(51) Int. Cl.[7] ..... B21D 24/04
(52) U.S. Cl. ..... 72/347; 72/350
(58) Field of Search ..... 72/347, 350, 351

(56) References Cited

U.S. PATENT DOCUMENTS

| | | | | |
|---|---|---|---|---|
| 2,324,205 | * | 7/1943 | Gladfelter et al. | 72/351 |
| 3,817,076 | * | 6/1974 | Wallace | 72/351 |
| 4,472,955 | | 9/1984 | Nakamura et al. | 72/57 |
| 4,516,420 | | 5/1985 | Bulso, Jr. et al. | 72/329 |
| 4,796,454 | | 1/1989 | Bulso, Jr. et al. | 72/350 |
| 5,333,484 | | 8/1994 | Mine et al. | 72/349 |
| 5,477,723 | | 12/1995 | Kergen | 72/350 |
| 5,626,048 | | 5/1997 | McClung | 72/336 |
| 5,628,224 | | 5/1997 | McClung et al. | 72/336 |
| 5,634,366 | | 6/1997 | Stodd | 72/348 |

* cited by examiner

*Primary Examiner*—Lowell A. Larson
(74) *Attorney, Agent, or Firm*—Sand & Sebolt

(57) ABSTRACT

Apparatus and method for forming cup-shaped metal members from a flat metal sheet in a press having a ram which moves a cut edge, draw horn and draw pad towards a base holding a blank and draw die. The draw pad is formed with an annular tapered relief area extending from its clamping surface to an annular wall of a central opening formed in the draw pad for reducing the clamping force which is exerted on a peripheral edge of the disk blank as the draw horn advances into the die opening of the blank and draw die to form the cup-shaped member. The angle of taper of the relief area is generally in the range of 4° and 10°. This tapered area reduces excess pinching of the peripheral edge of the disk blank as it moves around the die radius as the draw horn draws the disk blank into the cup-shaped member.

16 Claims, 6 Drawing Sheets

FIG-4
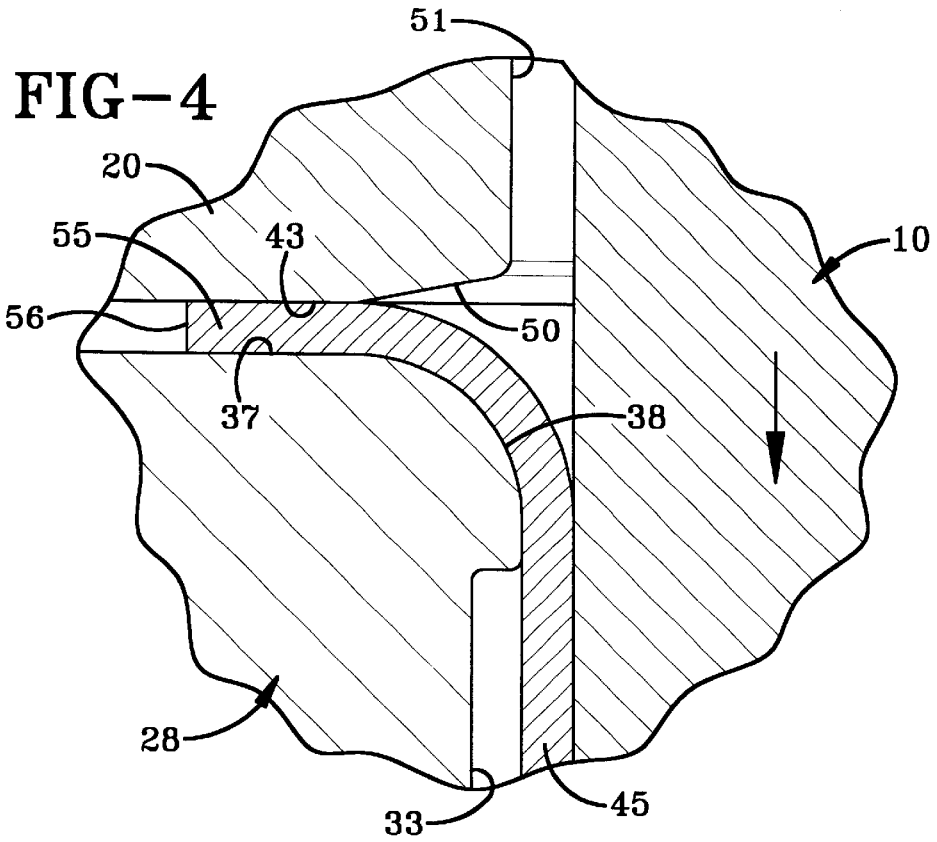
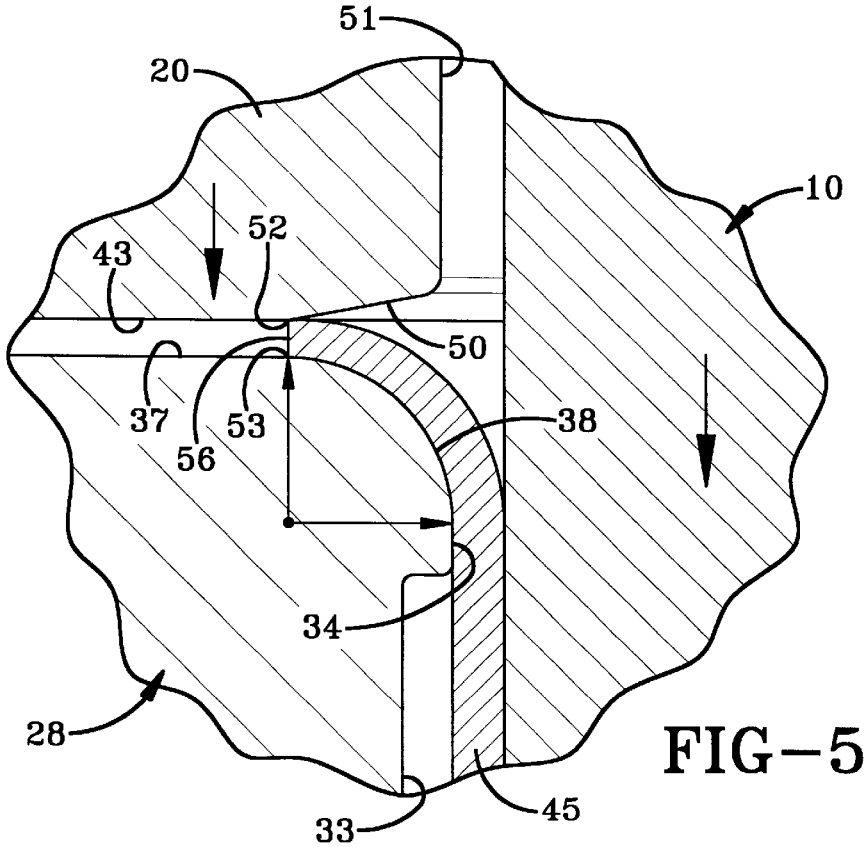
FIG-5

FIG-6
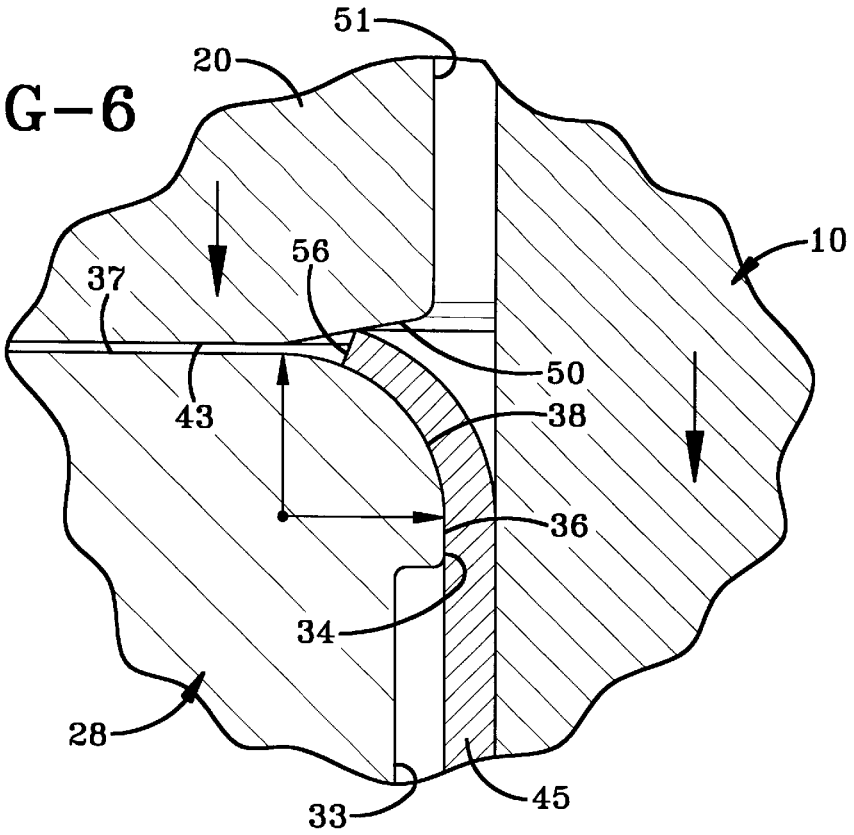
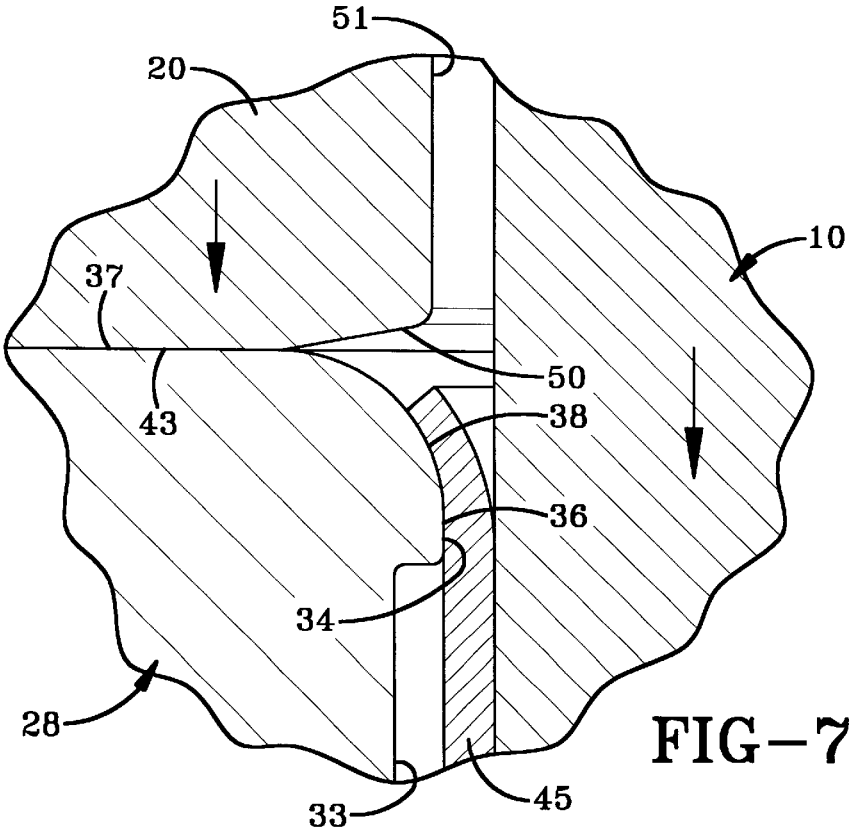
FIG-7

FIG-8
PRIOR ART
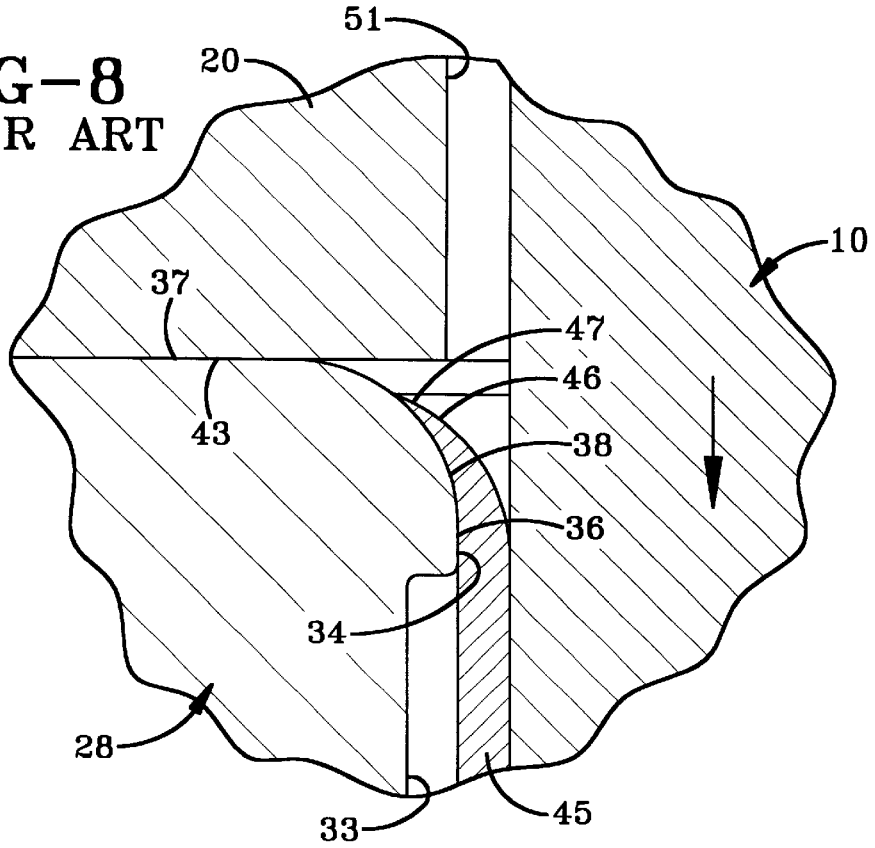
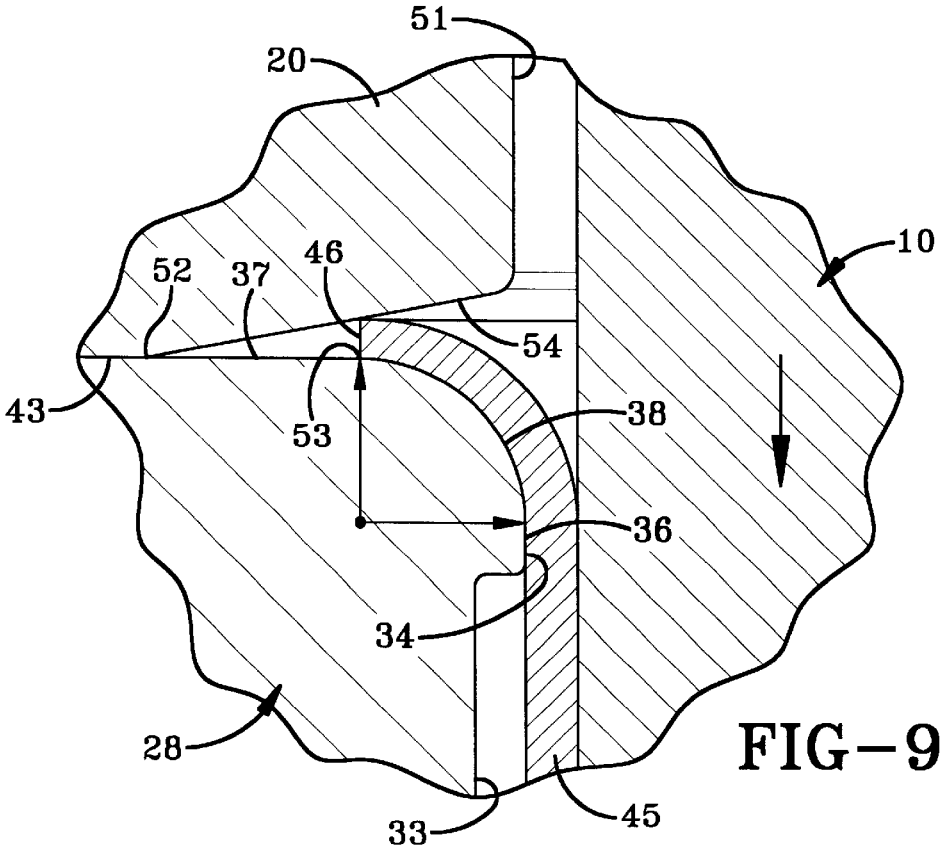
FIG-9

FIG-10
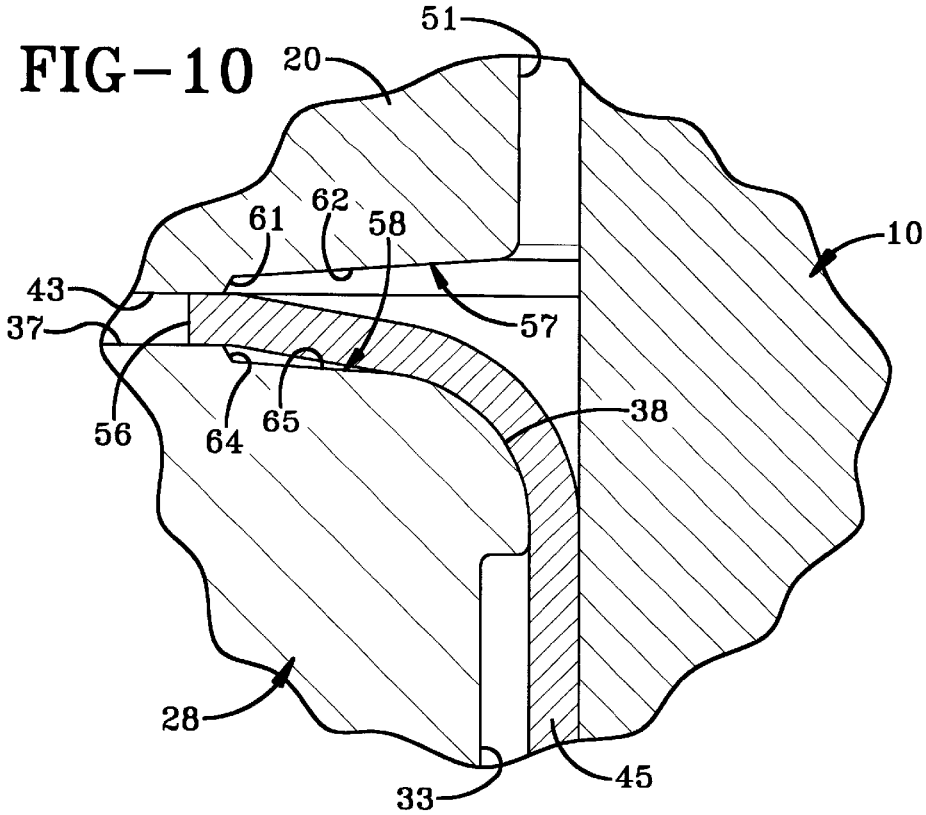
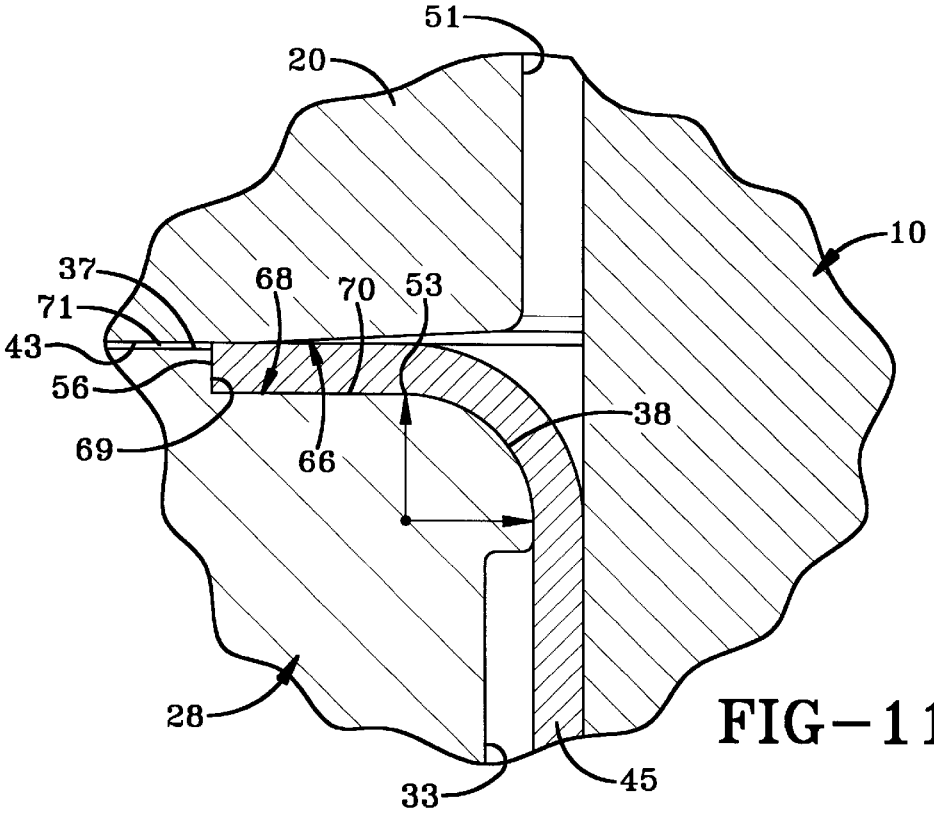
FIG-11

APPARATUS AND METHOD FOR FORMING CUP-SHAPED MEMBERS

BACKGROUND OF THE INVENTION

TECHNICAL FIELD

The invention relates to forming cup-shaped members such as container bodies from a blank of metal, and in particular to forming such bodies in a press which reduces the wrinkling and splintering of the peripheral edge of a blank disk as it is drawn around the draw forming radius and into the opening of a blank and draw die by providing the draw pad with an annular tapered relief area adjacent a central ram opening for reducing the clamping force on a peripheral edge of the disk blank as it moves around the draw forming radius of the blank and draw die and into the die opening.

BACKGROUND INFORMATION

It is well known in the container forming art to form two piece containers, that is containers in which the sidewalls and bottom of the container is a one piece member and the top or end closure is a separate piece by stamping disk shaped blanks from a strip of metal sheet then subsequently drawing the desired can body configuration into the disk blank in either a single or double acting press. Examples of such a method and apparatus are shown in numerous patents including U.S. Pat. Nos. 5,626,048 and 5,628,224. These patents as well as other prior art discloses that flat sheet material such as steel or aluminum, either in sheet or coil form, is initially blanked by an annular cutting edge and then drawn into a cup shape for subsequent redrawing into a final container in the same press or in subsequent presses and operations. Generally these prior art presses will simultaneously form a plurality of container bodies in the single stroke of the single or double acting press.

However, one problem that is encountered with these prior art presses is that the peripheral edge of the disk blank is excessively pinched as it moves around the inner radius of the die opening of the blank and draw die into which the metal of the disk blank is being drawn by the draw horn to form the cup-shaped member by the pressure exerted on the peripheral edge by the draw pad. In a double action press, the timing of the inner and outer rams is adjusted in an attempt to have the draw pad move upwardly in order to reduce the clamping pressure on the peripheral edge at the instant of time that the edge is moving around the radius and into the die opening. However, due to the extreme speeds that these presses operate and the metal thinness and tolerances between the parts of the die and press it is difficult to achieve the desired results. This excess pinching of the peripheral edge results in flattening the peripheral edge into an extremely sharp edge resulting in bits of metal splintering off from the disk and from a preapplied coating for certain strip materials. These splinters quickly accumulate and affect the operation of the press and require maintenance and repair problems.

This pinching problem of the peripheral disk blank edge is also critical in a single action press where the clamping pressure exerted on the disk blank remains generally constant until the metal has been pulled from between the clamping surfaces of the draw pad and blank and draw die by movement into the die opening by the draw horn and there is no mechanism for attempting to reduce the pressure on the draw pad at this critical instant in the forming operation as in a double acting press.

Many of these problems are eliminated by controlling the gap between the opposed clamping surfaces of the draw pad and the blank and draw die by providing an annular rib on an outer periphery of the draw pad as shown in pending application Ser. No. 09/093,250, filed Jun. 8, 1998. However, for certain applications the subject invention may provide a better solution than that of this referred to application.

Therefore, the need exists for an improved press and the apparatus therefor and to a method of forming a cup-shaped member which will enable the clamping pressure to be minimized on the peripheral edge of the disk shaped blank as it moves around the draw forming radius of the die as the metal is drawn into the die cavity by the draw horn to reduce excess pinching and with the resultant splintering of metal chips and slivers therefrom without requiring a substantial modification to the press or to its mode of operation.

SUMMARY OF THE INVENTION

Objectives of the invention include providing an improved apparatus and method for forming cup-shaped members such as container bodies, in either a single or double acting press from sheet metal material, wherein the material is formed into disk-shaped blanks and then drawn into a cylindrical cup-shaped configuration in a single stroke of the press, which automatically prevents excessive clamping pressure being applied to the peripheral edge of the disk blank as it moves around the radius of the die cavity or opening when being drawn into a cup shape by the draw horn.

Another objective is to provide such a method and apparatus which enables the desired amount of clamping pressure to be exerted on the disk blank as it is being drawn into the die cavity by the draw horn and which prevents the clamping pressure from excessively squeezing the peripheral edge of the blank disk into a pointed configuration with the resultant slivering of metal particles therefrom by providing the draw pad with an annular tapered relief area at the periphery of the ram opening or by providing a tapered or recessed relief area at the periphery of the blank and draw die opening adjacent the forming radius thereof, thereby limiting movement of the draw pad against the peripheral edge which heretofore had produced the pointed configuration and slivered particles.

Another objective of the invention is to provide such a method and apparatus which requires relatively minor adjustments to existing press and die constructions and operations thereof, thus avoiding complicated and expensive modifications for retrofitting existing presses.

These objectives and advantages are obtained by the improved apparatus of the invention for use in forming a cup-shaped member from a metal sheet in a press having at least one ram and a base wherein the general nature of said apparatus includes a draw pad and a draw horn carried by the ram and a blank and draw die carried by the base in opposed relationship to the draw pad and draw horn, said draw pad having a clamping surface and a central opening defined by an annular wall through which the draw horn is reciprocally moveable; the blank and draw die having a clamping surface opposed to the clamping surface of the draw pad for releasably clamping a disk blank therebetween; said die further having a die opening defined by an annular wall and a draw forming radius extending between said annular wall and the clamping surface; a cutting edge carried by the ram and surrounding the draw horn for cutting the disk blank from the metal sheet; and the draw pad having an annular tapered relief area extending from its clamping surface to the annular wall of the central opening for reducing the clamping force exerted on a peripheral edge of the disk blank as the draw horn advances into the die opening to form the cup-shaped member from the disk blank.

These objectives and advantages are further obtained by the improved method of the invention for forming a cup shaped member from a metal sheet in a press having a base and a blank and draw die mounted thereon, said die having a die spring and a forming radius at an entrance of said opening; and at least one ram for moving a draw pad, a draw horn and a cut edge toward said die; said method includes the steps of feeding the metal sheet between the die and the draw horn, draw pad and cut edge; providing the draw pad and the die with opposed clamping surfaces with the draw pad having a tapered relief area extending from the clamping surface thereof to a central opening formed in said draw pad for receiving the draw horn therein; advancing the cut edge, draw pad and draw horn toward the metal sheet and the die by movement of the ram; blanking a disk blank from the metal sheet by advancing the cut edge; initially clamping an outer annular portion of the disk blank between the clamping surfaces of the draw pad and blank and draw die; continuing advancing the draw horn towards the disk blank to begin drawing the disk into the die cavity; maintaining clamping pressure against the disk blank and the clamping surface of the die by the draw pad until a peripheral edge of said disk blank commences movement around the forming radius of said die; and then continuing advancing the draw pad into the die cavity whereupon an outer peripheral edge of the disk blank moves along the tapered relief area of the draw pad to reduce the clamping pressure thereon as the draw horn continues to advance into the die cavity and draws the cup-shaped member.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

FIG. 4 is a further enlarged fragmentary sectional view similar to FIGS. 2 and 3 showing the peripheral edge of the disc-shaped blank as it moves around the inner radius of the cup forming cavity of the blank and draw die;

FIG. 5 is an enlarged fragmentary sectional view similar to FIGS. 2–4 showing the position of the apparatus as the peripheral edge of the disc-shaped blank moves into the cup forming cavity and out of contact with the clamping surface of the draw pad and die;

FIG. 6 is an enlarged fragmentary sectional view similar to FIGS. 2–5 showing the peripheral edge of the disc-shaped blank as it moves further out of contact with the clamping surface of the draw pad and draw die;

FIG. 7 is a view similar to FIGS. 2–6 showing the peripheral edge of a cup-shaped member when formed by the method and apparatus of the present invention;

FIG. 8 is a view similar to FIG. 7 showing the peripheral edge of a cup-shaped blank produced by the prior art apparatus as shown in FIG. 2A; and FIGS. 9, 10 and 11 are enlarged fragmentary sectional views similar to FIG. 6 showing additional embodiments of the improved apparatus for producing the cup-shaped members.

Similar numerals refer to similar parts throughout the drawings.

DESCRIPTION OF THE PREFERRED EMBODIMENTS

Figure 1:
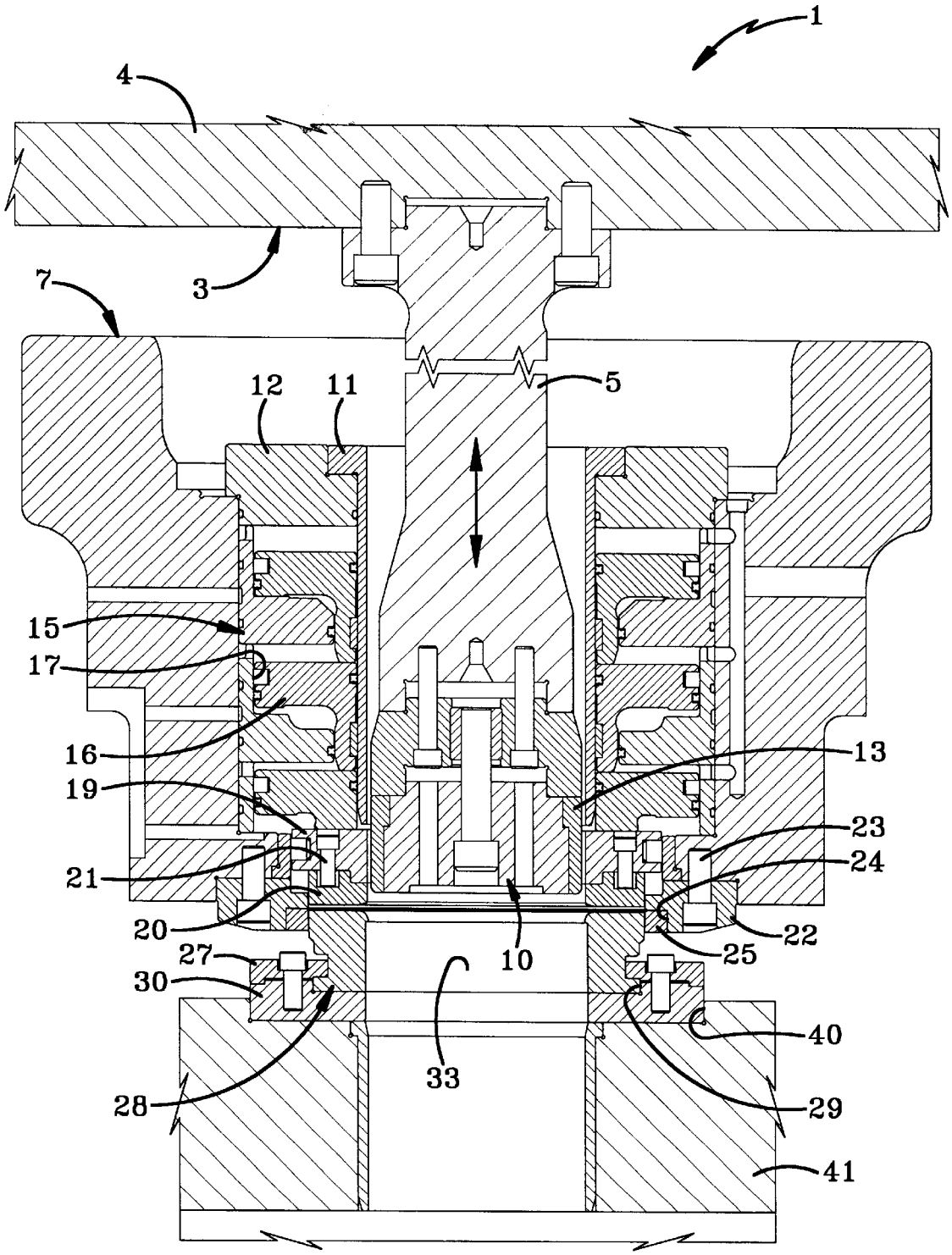
FIG. 1 is a fragmentary sectional view of a double action press for carrying out the method steps of the present invention having the improved apparatus incorporated therein.

The method and apparatus of the present invention can be utilized in conjunction with a double acting press, some examples of which are shown and described in U.S. Pat. Nos. 3,902,348; 5,626,048 and 5,628,224 and shown in FIG. 1 of the present drawing and indicated generally at 1. However, the method and apparatus also can be carried out in a single action press without affecting the invention. The main features of press 1 are described briefly below. Press 1 includes an inner ram indicated generally at 3, which includes a header plate 4, which is connected to an inner punch 5 and an outer frame 7 which surrounds punch 5, and which is connected to and controlled by an outer ram (not shown). A usual draw horn 10 is connected to the lower end of inner punch 5 and may be a usual one or two piece construction with the associated mounting bolts and air passages and is movable in a reciprocal vertical direction upon movement of ram 3 as is well known in the press art.

A cylindrical guide sleeve 11 surrounds draw horn 10 and is connected to an annular cap 12. Cap 12 is connected to outer frame 7 and forms the upper closure for a pneumatic piston assembly indicated generally at 15. The piston assembly may be of various constructions such as shown in U.S. Pat. Nos. 5,626,048 and 5,628,224, and consists of a plurality of vertically stacked pistons 16 reciprocally movably mounted within an annular bore or cylinder 17. The lowermost piston 16 engages a draw pad mounting ring 19 which in turn is connected to draw pad 20 by bolts 21. An annular retaining ring 22 is connected by bolts 23 to the lower end of outer frame 7 and is formed with an annular recess 24 in which an annular cut edge 25 is mounted. Draw horn 10 may be provided with a hardened outer annular case 13 as shown in the drawings or could be of a one-piece construction without affecting its manner of operation in the present invention. An annular draw die clamp 27 secures an annular blank and draw die indicated generally at 28, into an annular recess 29 formed in a retainer ring 30 by a plurality of bolts 31. Blank and draw die 28 is formed with an inner annular cavity or opening 33, the upper portion of which has a reduced diameter annular opening 34 defined by a cylindrical wall 36 which merges into a horizontal top clamping surface 37 by a forming radius 38. In the preferred embodiment, forming radius will be approximately 0.125 inches. Retainer ring 30 is mounted within an annular recess 40 formed in a supporting base 41.

All of the above described components and features of press 1 are well known in the art and provide the preferred construction and environment in which the improved feature of the present invention is incorporated and the method steps carried out which is now described in further detail below.

Figure 2:
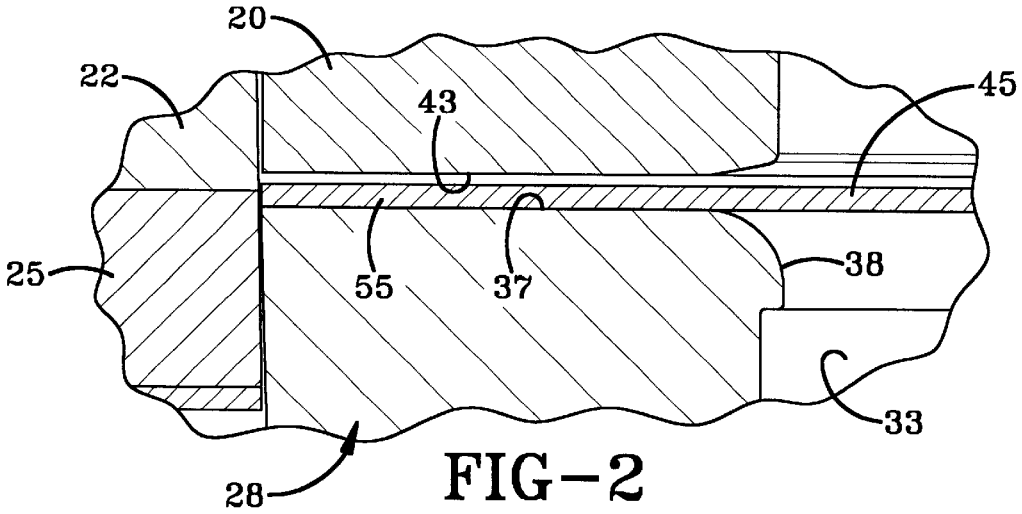
FIG. 2 is an enlarged fragmentary sectional view showing the pressure relief feature of the invention at the start of a cup forming operation.
Figure 2A:
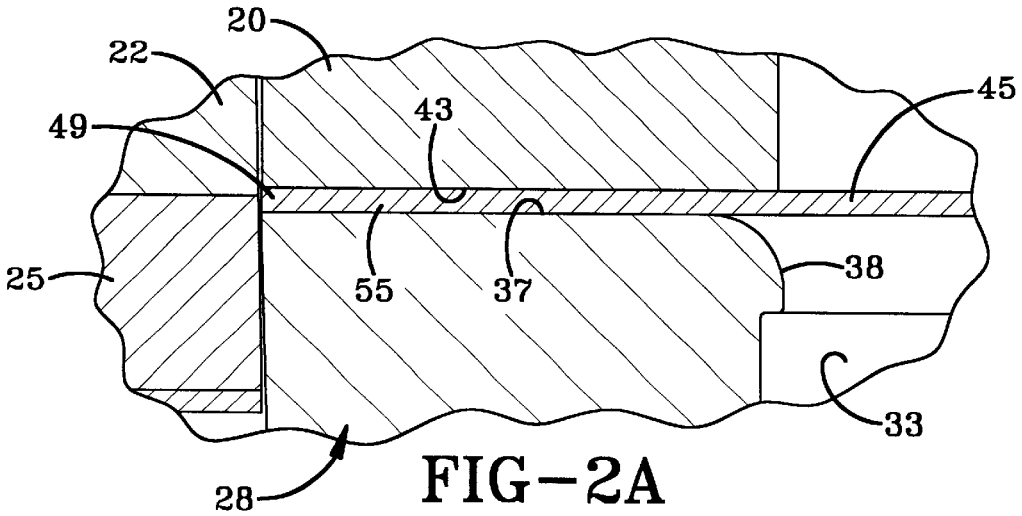
FIG-2A PRIOR ART
FIG. 2A is a fragmentary sectional view similar to FIG. 2 showing the prior art apparatus on which the present invention is an improvement thereon.
Figure 3:
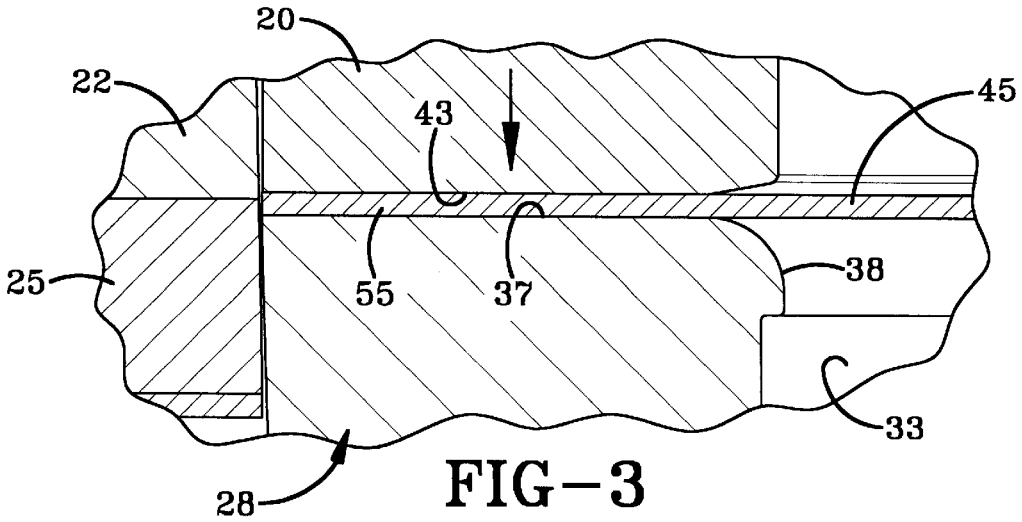
FIG. 3 is a view similar to FIG. 2 showing the pressure relief apparatus clampingly engaging an outer annular portion of the disc-shaped blank at the start of the drawing step.

In the usual operation of a single or double action press as shown in FIG. 2A, draw pad 20 will have a continuous flat annular clamping surface 43 which will clamp a disk blank 45 against top clamping surface 37 of blank and draw die 28 throughout its entire length under the pneumatic pressure applied by piston assembly 15 as draw horn 10 moves downwardly to form a cup-shape blank 47 (FIG. 4). Draw horn 10 moves the metal of disk blank 45 into die cavity 33 with the outer annular portion of blank 45 that is trapped between annular clamping surfaces 43 and 37, moving inwardly towards die cavity 33 as it remains trapped between the opposed clamping surfaces. The pressure exerted by piston assembly 15 is sufficiently great to clamp the metal between surfaces 37 and 43 yet not too great to prevent the metal from being pulled therefrom by the movement of the draw horn without stretching or thinning the metal. However, as the outer peripheral edge portion 46 of disk blank 45 reaches the inner end of clamping surface 37 generally at the start of forming radius 38 as shown in FIGS. 4 and 5, the pressure exerted by draw horn 10 on the very small annular area of the remaining metal will pinch the metal as it is moving outwardly from between clamping surfaces 37 and 43 so that as it exits the clamping area, it will cause a sharper tapered edge 47 to be formed thereon as shown in FIG. 8. This results in the splintering of small bits or slivers of metal from the disk edge, which after a number of press operations can accumulate and foul up the dies and transfer mechanisms possibly damaging the same or requiring preventive maintenance and periodic cleaning causing the press operation to be stopped.

As described previously, this problem of splintering is reduced somewhat in a double action press by adjusting the timing cycles of the inner and outer rams so that as the inner ram, which drives draw horn, approaches its maximum downward stroke and the edge of the disk reaches curved forming radius 38, the outer ram will begin to move upwardly so that the amount of clamping pressure exerted by piston assembly 15 on draw pad 20 is reduced in an attempt to eliminate or reduce this undesirable thinning and slivering of the disk end edges. However, such accurate control and timing is difficult to achieve to prevent such thinning and slivering of the disk edges.

This problem is avoided or materially reduced by the present invention which provides an annular relief area 50 at the inner end of clamping surface 43 of draw pad 20 as shown in FIGS. 2–7. Relief area 50 surrounds cylindrical opening 51 formed in draw pad 20 through which draw horn 10 reciprocally moves in forming the cup-shaped member. In the preferred embodiment, relief area 50 is a smooth flat surface and will have a taper generally in the range of 4° and 10° with the preferred angle of taper being generally 7°. The preferred starting point indicated at 52 as shown in FIG. 5 is at a location in clamping surface 43 which axially aligns at the start of the draw forming radius indicated at 53 of die opening 34. Although this has been found to be the preferred angle of taper of the relief area and the preferred starting point, this could vary without materially affecting the invention as shown particularly in FIG. 9, wherein the starting point 52 of relief area 54 is before radius starting point 53.

The metal sheets from which disc blanks 45 are cut preferably are formed of aluminum and have a preferred thickness of approximately 0.011 inches for many applications such as production of beverage cans. However, this thickness may vary for different containers and may have a thickness between 0.005 inches and 0.030 inches.

The manner of using the improved apparatus of the present invention and in particular the reduction of the clamping pressure on a peripheral edge 46 for carrying out the unique method is best shown in FIGS. 2–7. Either before or after cut edge 25 severs the metal strip to form disc blank 45, draw pad 20 is moved downwardly clamping an outer annular area 55 of disc blank 45 between clamping surfaces 43 and 37 as shown particularly in FIG. 3. As draw horn 10 moves downwardly as shown by the arrow in FIG. 4, it will engage disc blank 45 and move the metal around forming radius 38 of blank and draw die 28 while draw pad 20 maintains a predetermined clamping force against outer annular area 55. Draw horn 10 will continue to advance downwardly as shown in FIG. 5 slidably moving the metal from between clamping surfaces 43 and 37 and around forming radius 38 until the outer peripheral edge 56 of disc blank 45 reaches the starting point 52 of relief area 50, afterwhich draw pad 20 will move closer to blank and draw die 28 as shown in FIG. 6 to reduce the gap therebetween which heretofore was approximately the size of the metal thickness of blank 45. Peripheral edge 56 continues to move along forming radius 38 while still under a clamping pressure although reduced, exerted by annular relief area 50. This reduced clamping pressure will result in a slight tapering of peripheral edge 56 as shown in FIG. 7 but will not apply excess clamping pressure thereto as occurs with the prior art apparatus as shown in FIG. 8. This avoids the formation of slivered peripheral edge 47. As edge 56 moves from the position of FIG. 6 to that of FIG. 7, draw pad 20 will bottom out against blank and draw die 28 without excess clamping force being exerted on edge 56 due to relief area 50.

Although the above sequence of operation and results achieved by the use of relief area 50 is described in great detail above and shown in a sequence of drawings, in actual press operation, such movement of the various press components occurs in less than a second. However, as shown in the drawings and described above, relief area 50 clearly prevents the formation of sharp edge 47 thereby reducing the splintering of metal particles therefrom or from a coating which may have been previously applied to the metal strip when forming certain containers. Also, this desired result is achieved in a relatively simple but effective manner by modifying the usual draw pad by grinding or providing a relief area 50 thereto and is effective for use in both single and double acting presses.

As discussed above, FIG. 9 shows a slightly modified embodiment in which the start of the relief area 54 is at a point before the starting point 53 of the die forming radius surface. The remaining operations and movement is similar to that shown in FIGS. 2–7 and discussed above. Relief area 54 will have a similar angle of taper as relief area 50.

A further embodiment is shown in FIG. 10. In this embodiment, the relief area is provided by a pair of relief surfaces indicated generally at 57 and 58, formed in clamping surfaces 43 and 37 respectively, of draw horn 20 and blank and draw die 28. Each relief surface 57 and 58 includes first and second portions 61 and 62, and 64 and 65, respectively. In the embodiment shown in FIG. 10, first portions 61 and 64 of relief surfaces 57 and 58 preferably have an angle of taper of approximately 45°. The second portions 62 and 65 preferably have angles of taper generally less than 7°. In this embodiment, clamping surfaces 43 and 37 will almost contact each other until outer peripheral edge 56 passes beyond first relief portions 61 and 64 and into contact with the second relief portions 62 and 64 thus providing a diminishing pressure engagement therewith as edge 56 moves around forming radius 38. Portions 61 and 64 are considerably shorter in length than portions 62 and 65 as shown in FIG. 10.

FIG. 11 shows a further modified embodiment of the improved pressure relief apparatus in which a relief area 66 is formed in draw pad 20 and starts at a position generally outwardly from the radius start point 53 and extends at an angle of taper less than that of relief area 50. A second relief area 68 is formed in clamping surface 37 of blank and draw die 28 and has a first portion 69 which extends generally perpendicular to surface 37 with a second relief portion 70 which is either parallel with surface 37 or very slightly tapered with respect thereto, for example a taper generally less than 7°. Peripheral edge 56 of disc blank 45 will drop into relief area 68 relieving most of the clamping pressure thereon. The pressure is then reduced as edge 56 moves inwardly along relief area 66. Surfaces 37 and 43 will have a gap 71 therebetween when edge 56 first enters relief area 68 which will then decrease as edge 56 moves along second portion 70. Gap 71 will be approximately 10% of the metal thickness of disc blank 45 when clamping surfaces 37 and 43 are in the position as shown in FIG. 10.

Accordingly, the improved apparatus and method for forming cup-shaped members is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved apparatus and method for forming cupshaped members is construed and used, the characteristics of the construction, and the advantageous, new and useful results obtained; the new and useful structures, devices, elements, arrangements, parts and combinations, are set forth in the appended claims.

What is claimed is:

1. Apparatus for forming a cup-shaped member from a metal sheet in a press having at least one ram and a base, said apparatus including:

a draw pad and a draw horn carried by the ram and a blank and draw die carried by the base in opposed relationship to the draw pad and draw horn, said draw pad having a clamping surface and a central opening defined by an annular wall through which the draw horn is reciprocally moveable; the blank and draw die having a clamping surface opposed to a clamping surface of the draw pad for releasably clamping a disk blank therebetween; said blank and draw die further having a die opening defined by an annular wall and a draw forming radius extending between said annular wall and said clamping surface;

a cutting edge carried by the ram and surrounding the draw horn for cutting the disk blank from the metal sheet;

the draw pad having a first annular tapered relief area formed in its clamping surface and extending to the central opening; and the blank and draw die having a second relief area formed in its clamping surface adjacent the draw forming radius, said second relief area having first and second portions, said first portion having an angle of taper of approximately 45° extending from said clamping surface to the second portion which has an angle of taper generally less than 7° and which extends form said first tapered portion to the draw forming radius, said first and second relief areas reducing the clamping force exerted on a peripheral edge of the disk blank as the draw horn advances into the die opening to form the cup-shaped member form the disk blank.

2. A method of forming a cup-shaped member form a metal sheet in a press having a base and a blank and draw die mounted thereon, said die having a die opening and a forming radius at an entrance of said opening; and at least one ram for moving a draw pad, a draw horn and a cut edge toward said die; said method includes the steps of:

a) feeding the metal sheet between the die and the draw horn, draw pad and cut edge;

b) providing the draw pad and the die with opposed clamping surfaces;

c) providing the draw pad with a first tapered relief area extending from the clamping surface thereof to a central opening formed in said draw pad for receiving the draw horn therein;

d) providing a second relief area in the clamping surface of the blank and draw die, said second relief area having first and second surfaces, said first surface extending generally perpendicular to the clamping surface of the blank and draw die and the second surface extending generally parallel to said clamping surface of said die;

e) advancing the cut edge, draw pad and draw horn toward the metal sheet and die by movement of the ram;

f) blanking a disk blank from the metal sheet by advancing the cut edge;

g) initially clamping an outer portion of the disk blank between the clamping surfaces of the draw pad and blank and draw die;

h) continuing advancing the draw horn towards the disk blank to begin drawing the disk into the die cavity;

i) maintaining clamping pressure against the disk blank and the clamping surface of the die by the draw pad until a peripheral edge of said disk blank approaches the forming radius of said die; and j) and then continuing advancing the draw pad into the die cavity whereupon an outer peripheral edge of the disk blank moves along the tapered relief areas of the draw pad and blank and draw die to reduce the clamping pressure thereon as the draw horn continues to advance into the die cavity and draws the cup-shaped member.

3. The method defined in claim 2 including the step of providing the first relief area with a smooth annular surface having an angle of taper generally within the range of 4° and 10°.

4. The method defined in claim 3 including the step of providing the first relief area with an angle of taper of 7°.

5. The method defined in claim 2 including the step of beginning the angle of taper of the first relief area at a point in general axial alignment with the start of the draw forming radius of the blank and draw die.

6. The method defined in claim 2 including the step of providing the first surface of the second relief area with a length approximately 90% of the thickness of the disk blank.

7. Apparatus for forming a cup-shaped member from a metal sheet in a press having at least one ram and a base, said apparatus including:

a draw pad and a draw horn carried by the ram and a blank and draw die carried by the base in opposed relationship to the draw pad and draw horn, said draw pad having a clamping surface and a central opening defined by an annular wall through which the draw horn is reciprocally moveable; the blank and draw die further having a die opening defined by an annular wall and a draw forming radius extending between said annular wall and the clamping surface;

a cutting edge carried by the ram and surrounding the draw horn for cutting the disk blank from the metal sheet;

a first annular tapered relief area extending from the clamping surface of the draw pad toward the annular wall of the central opening; and a second annular relief area formed in the clamping surface of the blank and draw die opposed to the first annular relief area for reducing the clamping force exerted on a peripheral edge of the disk blank as the draw horn advances into the die opening to form the cup-shaped member form the disk blank.

8. The apparatus defined in claim 7 in which the angle of taper of the first relief area is generally in the range of 4° and 10°.

9. The apparatus defined in claim 8 in which the angle of taper of the first relief area is generally 7°.

10. The apparatus defined in claim 7 in which a starting point of the first relief area when viewed in cross section is in general alignment with the start of the draw forming radius of the die opening.

11. The apparatus defined in claim 10 in which the first relief area is a smooth flat annular surface.

12. The apparatus defined in claim 7 in which the second annular relief area includes first and second portions, said first portion extending from said clamping surface to the second portion which extends from said first portion to the draw forming radius.

13. The apparatus defined in claim 12 in which the first portion has an angle of taper of approximately 45°; and in which the second portion has an angle of taper generally less than 7°.

14. The apparatus defined in claim 12 in which the first portion forms a substantially right angle with the second portion; and in which the second portion is substantially parallel with the clamping surface of the blank and draw die.

15. The apparatus defined in claim 7 in which the second relief area includes first and second annular tapered surfaces, with said first surface being shorter in length than said second surface.

16. The apparatus defined in claim 15 in which the first tapered surface of the draw pad relief area has an angle of taper of approximately 45°.

* * * * *